US007227300B2

(12) United States Patent
Yoshinaga et al.

(10) Patent No.: US 7,227,300 B2
(45) Date of Patent: Jun. 5, 2007

(54) PROJECTION TUBE APPARATUS

(75) Inventors: Takahiko Yoshinaga, Takatsuki (JP); Kenichiro Taniwa, Takatsuki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 349 days.

(21) Appl. No.: 11/055,237

(22) Filed: Feb. 8, 2005

(65) Prior Publication Data

US 2005/0189861 A1 Sep. 1, 2005

(30) Foreign Application Priority Data

Feb. 27, 2004 (JP) ..... 2004-054620

(51) Int. Cl.
*H01J 29/70* (2006.01)

(52) U.S. Cl. ..... 313/431; 313/426; 313/440

(58) Field of Classification Search ..... 313/421, 313/431, 426, 440; 335/296, 299
See application file for complete search history.

(56) References Cited

U.S. PATENT DOCUMENTS 6,307,314 B1 * 10/2001 Sano ..... 313/440
6,750,602 B2 * 6/2004 Hirota et al. ..... 313/477 R
7,015,634 B2 * 3/2006 Watanabe et al. ..... 313/442

FOREIGN PATENT DOCUMENTS

JP 2003-123669 4/2003

* cited by examiner

*Primary Examiner*—Ashok Patel
(74) *Attorney, Agent, or Firm*—Hamre, Schumann, Mueller & Larson, P.C.

(57) ABSTRACT

A projection tube apparatus includes: a valve made up of a face panel having a screen face on its external face, a funnel connected to a rear portion of the face panel, and a neck portion; an electron gun that emits an electron beam and is housed in the neck portion; and a deflection device mounted at an outer circumference of the funnel on the neck portion side. The deflection device at least includes: horizontal deflection coils that generate a horizontal deflection field for deflecting the electron beam in the horizontal direction; vertical deflection coils that generate a vertical deflection field for deflecting the electron beam in the vertical direction and is disposed outside the horizontal deflection coils; and a ferrite core disposed outside the vertical deflection coils. A distance Ls between an end portion of the horizontal deflection coils on the screen face side and the screen face is set to 55 mm≦Ls≦80 mm.

2 Claims, 13 Drawing Sheets

PROJECTION TUBE APPARATUS

BACKGROUND OF INVENTION

1. Field of the Invention

The present invention relates to projection tube apparatuses, and more specifically, to projection tube apparatuses equipped with deflection devices for deflecting an electron beam emitted from an electron gun in vertical and horizontal directions.

2. Description of the Related Art

Generally, for higher resolution of projection-type projection televisions, a deflection field of a deflection device equipped with its projection tube apparatus is a substantially uniform magnetic field. Thus, pincushion distortions 1 (1*a*, 1*b*) of an image that occur due to geometric reasons as shown in FIG. 11 remain, and a correction circuit of a projection television set correct these pincushion distortions 1. Particularly, it is known that the proportion of the power necessary to correct the pincushion distortion 1*a* in upper and lower portions of the screen accounts for at least 10% of the entire power consumption of a projection television set. With an increasing demand for energy saving in recent years, projection television set manufacturers are facing design difficulties.

Conventionally, in order to solve the above-described problems, techniques as given below have been proposed (see e.g., JP 2003-123669A).

FIG. 12 shows a side view of a conventional deflection device. As shown in FIG. 12, the conventional deflection device 2 is made up of horizontal deflection coils 3, vertical deflection coils 4, and a core 5. In the vicinity 6 of an opening on the screen face side of the deflection device 2, horizontal correction coils 7 and vertical correction coils 8 are disposed at the left and right and the top and bottom of the opening, respectively. Here, the horizontal correction coils 7 are connected to the horizontal deflection coils 3 in series, and the vertical correction coils 8 are connected to the vertical deflection coils 4 in series.

The operation of the conventional deflection device 2 configured as above, particularly the operation of the vertical correction coils 8 is described below with reference to FIG. 13. FIG. 13 is a diagram for schematically describing the operation of the conventional deflection device. As shown in FIGS. 12 and 13, when a vertical deflection current passes through the vertical deflection coils 4, a current passes through the vertical correction coils 8 disposed at the top and bottom in the vicinity 6 of the opening on the screen face side of the deflection device 2, thereby generating a correction field 9. Thus, an electron beam 10 is subjected to the Lorentz force 11 in the direction away from the Z axis (the tube axis) in the vicinity of the upper and lower portions of the screen, and the pincushion distortion in the upper and lower portions of the screen is corrected. Similarly, when a horizontal deflection current passes through the horizontal deflection coils 3 and when a current passes through the horizontal correction coils 7, pincushion distortion in the left and right portions of the screen is corrected.

However, in the technique disclosed in JP 2003-123669A, the horizontal correction coils 7 and the vertical correction coils 8 are necessary in addition to the deflection device 2, and the number of manufacturing steps required for assembling these coils also increases, resulting in a problem of an increase in cost of the deflection device 2.

The present invention has been made in order to solve the above-described problem in the conventional art, and it is an object of the present invention to provide a projection tube apparatus that can correct the pincushion distortion at the upper and lower portions of the screen without adding any other components such as correction coils.

SUMMARY OF THE INVENTION

In order to achieve the above-described object, a configuration of the projection tube apparatus according to the present invention includes:

a valve made up of a face panel having a screen face on its external face, a funnel connected to a rear portion of the face panel, and a neck portion;

an electron gun that emits an electron beam and is housed in the neck portion; and a deflection device mounted at an outer circumference of the funnel on the neck portion side, wherein the deflection device at least includes: horizontal deflection coils that generate a horizontal deflection field for deflecting the electron beam in a horizontal direction; vertical deflection coils that generate a vertical deflection field for deflecting the electron beam in a vertical direction and is disposed outside the horizontal deflection coils; and a core disposed outside the vertical deflection coils; and wherein a distance Ls between an end portion of the horizontal deflection coils on the screen face side and the screen face is set to $55\ \text{mm} \leqq Ls \leqq 80\ \text{mm}$.

With this configuration of the projection tube apparatus, pincushion distortion in the upper and lower portions of a screen can be corrected efficiently without causing flicker on the screen. In this manner, the pincushion distortions in the upper and lower portions of a screen can be corrected without adding any other components such as correction coils, so that a projection tube apparatus whose power for correcting the pincushion distortions in the upper and lower portions of the screen is reduced can be provided at a low cost.

Furthermore, in the above-described configuration of the projection tube apparatus of the present invention, it is preferable that the distance Ls between the end portion of the horizontal deflection coils on the screen face side and the screen face is smaller than a distance Lw between a position on a Z-axis (tube axis) where a height in a direction of Y-axis (vertical axis) of a bend portion of the horizontal deflection coils on the screen face side is highest and the screen face, and a difference $\Delta Lws = Lw - Ls$ between Ls and Lw is set to $5\ \text{mm} \leqq \Delta Lws \leqq = 20\ \text{mm}$. According to this preferable example, the pincushion distortions in the upper and lower portions of the screen can be corrected efficiently while suppressing a winding defects of the horizontal deflection coils to a level of which there essentially is no problem.

According to the present invention, the pincushion distortions in the upper and lower portions of the screen can be corrected efficiently without adding any other components such as the correction coils, and screen flicker will not be caused. That is, according to the present invention, it is possible to correct the pincushion distortions in the upper and lower portions of the screen with an inexpensive system, and to realize a projection tube apparatus producing good image quality.

DESCRIPTION OF THE PREFERRED EMBODIMENTS

Hereinafter, the present invention will be described more specifically by way of an embodiment.

Figure 1:
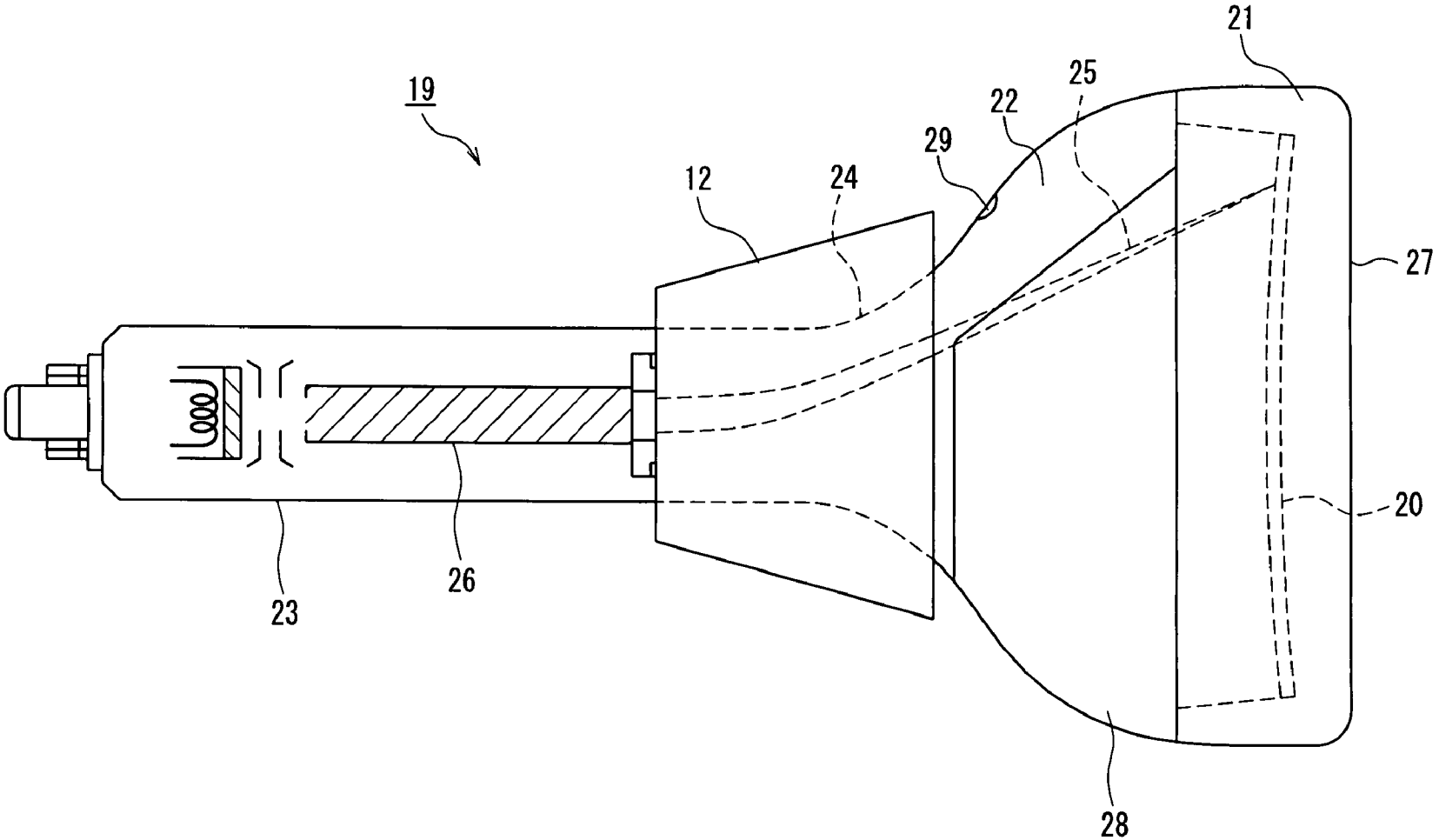
FIG. 1 is a top view showing a projection tube apparatus according to an embodiment of the present invention.

First, a projection tube apparatus according to this embodiment is described with reference to FIG. 1. FIG. 1 is a top view showing a projection tube apparatus according to an embodiment of the present invention.

As shown in FIG. 1, a projection tube apparatus 19 of this embodiment includes: a valve (vacuum envelope) made up of a face panel 21 made of glass or the like and having a substantially rectangular screen display portion 20 on its inner surface, a funnel-shaped funnel 22 also made of glass or the like and connected to the rear portion of the face panel 21, and a cylindrical neck portion 23; and an electron gun 26 that emits an electron beam 25 and is housed in the neck portion 23. Here, a substantially rectangular screen face 27 is formed on an external surface of the face panel 21 that is opposite to the screen display portion 20. Furthermore, a deflection device 12 for deflecting the electron beam 25 emitted from the electron gun 26 in the vertical and horizontal directions is mounted on an outer circumference of the funnel 22 on the neck portion 23 side.

The funnel 22 has a portion with a small diameter, or what is known as a yoke portion 24, extending from its junction with the neck portion 23 to an end portion of the deflection device 12 on the screen face 27 side. An external conductive material 28 is coated on the external surface of the funnel 22 from the vicinity of an opening of the deflection device 12 on the screen face 27 side to a junction between the face panel 21 and the funnel 22. Furthermore, an anode portion 29 is provided between the yoke portion 24 and the junction between the face panel 21 and the funnel 22, and a predetermined distance is kept between the end portion of the deflection device 12 on the screen face 27 side and the anode portion 29 for insulation. Furthermore, an internal conductive material (not shown) also is coated on the internal surface of the funnel 22 from the vicinity of the opening of the deflection device 12 on the screen face 27 side to the junction between the face panel 21 and funnel 22. By obtaining a desired capacitance through the external conductive material 28 and the internal conductive material, minute variation of a high voltage applied to the anode portion 29 is absorbed to prevent adverse effects on the image quality.

In the projection tube apparatus 19 having a configuration as described above, an image is formed on the screen face 27 by accelerating the electron beam 25 emitted from the electron gun 26 with a high voltage of about 30 kV applied to the anode portion 29, deflecting the electron beam 25 in the horizontal and vertical directions with the horizontal deflection field and vertical deflection field generated at the deflection device 12 in the yoke portion 24, and scanning the screen display portion 20 horizontally and vertically.

Figure 2:
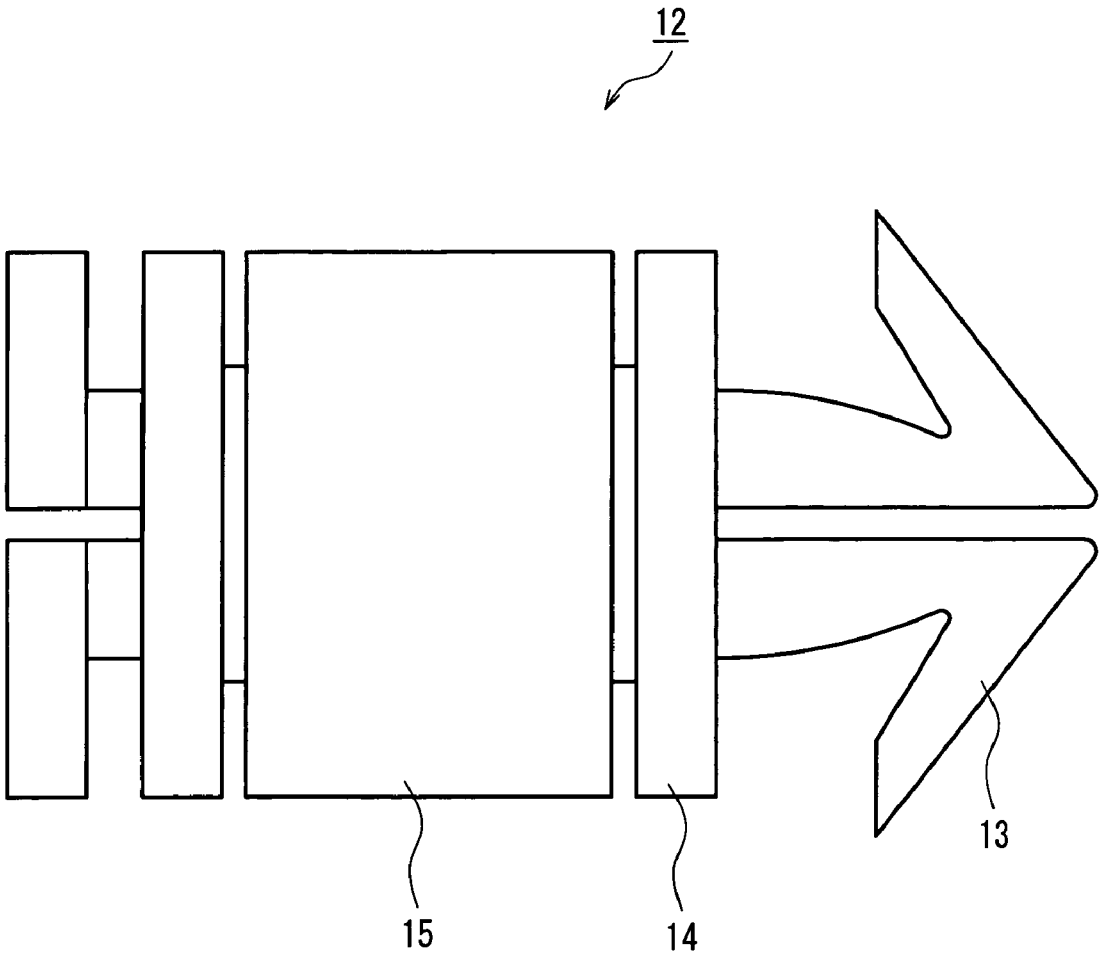
FIG. 2 is a side view showing a deflection device according to an embodiment of the present invention.

FIG. 2 shows a side view of a deflection device of this embodiment. As shown in FIG. 2, the deflection device 12 of this embodiment is constituted by horizontal deflection coils 13 that generate a horizontal deflection field for deflecting the electron beam 25 in the horizontal direction, vertical deflection coils 14 that generates a vertical deflection field for deflecting the electron beam 25 in the vertical direction and is disposed outside the horizontal deflection coils 13, and a ferrite core 15 disposed outside the vertical deflection coils 14.

Figures 3A, 3B:
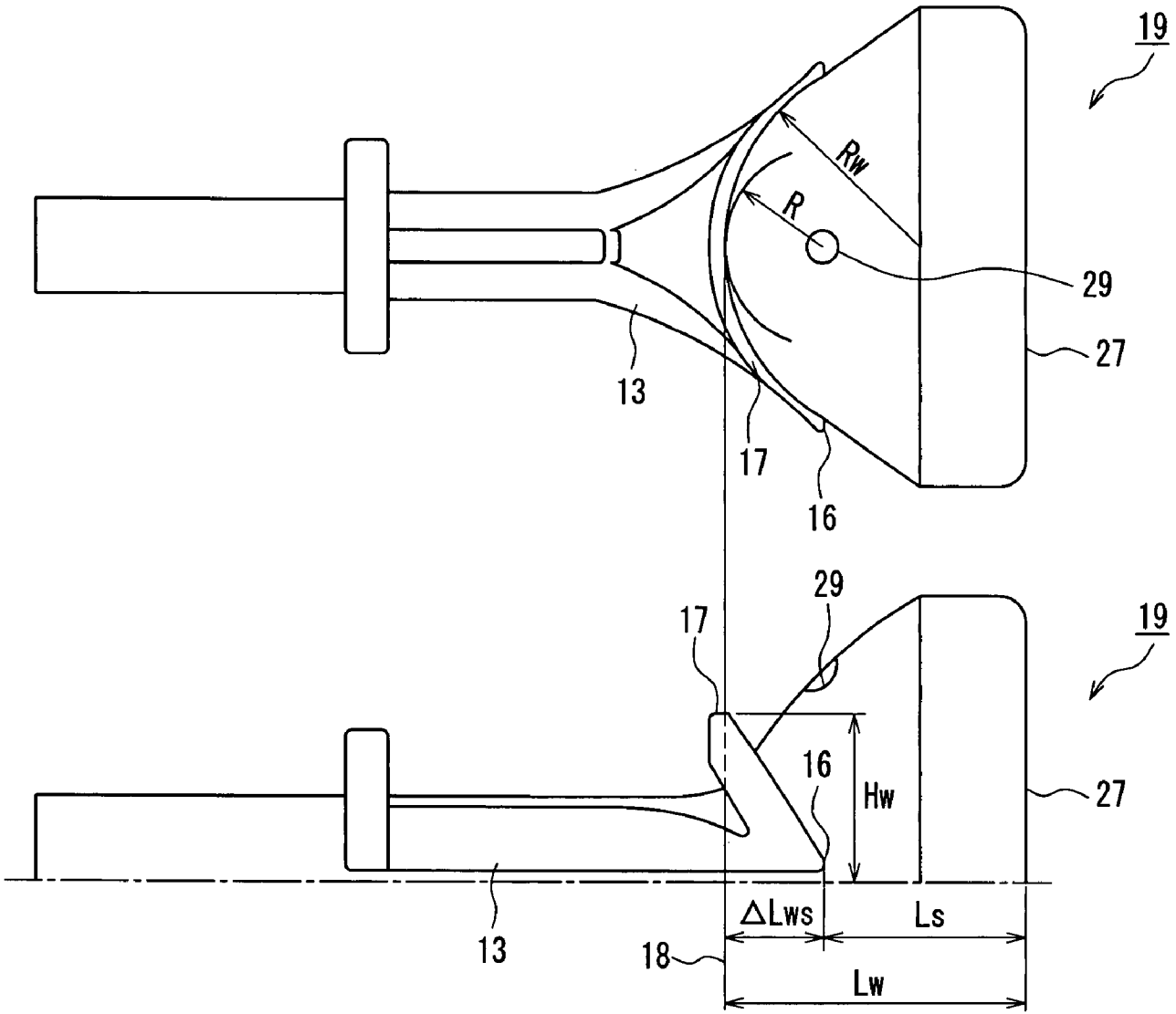
FIG. 3A is a top view of a projection tube apparatus on which horizontal deflection coils constituting a deflection device are mounted according to an embodiment of the present invention.
FIG. 3B is a side view thereof (top half only).

FIG. 3A shows a top view of a projection tube apparatus on which horizontal deflection coils constituting the deflection device are mounted according to this embodiment, and FIG. 3B shows a side view of the top half thereof.

As shown in FIGS. 3A and 3B, in the projection tube apparatus of this embodiment, a distance Ls between an end portion 16 of the horizontal deflection coils 13 on the screen face 27 side and the screen face 27 is set to 65 mm. Furthermore, in the projection tube apparatus of this embodiment, the distance Ls between the end portion 16 of the horizontal deflection coils 13 on the screen face 27 side and the screen face 27 is set smaller than a distance Lw between a position 18 on the Z-axis (tube axis) where a height Hw in the direction of Y-axis (vertical axis) of a bend portion 17 of the horizontal deflection coils 13 on the screen face 27 side is highest and the screen face 27, and a difference ΔLws=Lw−Ls between Ls and Lw is set to 17 mm. Furthermore, when viewed from above (FIG. 3A), a radius of curvature Rw of the bend portion 17 of the horizontal deflection coils 13 on the screen face 27 side is set larger than a segment R connecting the position 18 on the Z-axis (tube axis) where the height Hw in the direction of Y-axis (vertical axis) of the bend portion 17 is highest and the anode portion 29. It should be noted that the foregoing dimensional settings and the dimensional settings described below are for the 16 cm (7 inches) projection tube apparatus.

By providing dimensional settings as described above, the pincushion distortions in upper and lower portions of the screen can be corrected efficiently, and the effects of the minute variation of a high voltage applied to the anode portion 29 on the image quality also can be suppressed. Furthermore, a desired insulation distance can be ensured between the horizontal deflection coils 13 and the anode portion 29. The dimensional settings of the horizontal deflection coils that can obtain these effects are described in further detail below based on the experiments conducted by the inventors.

Figure 4:
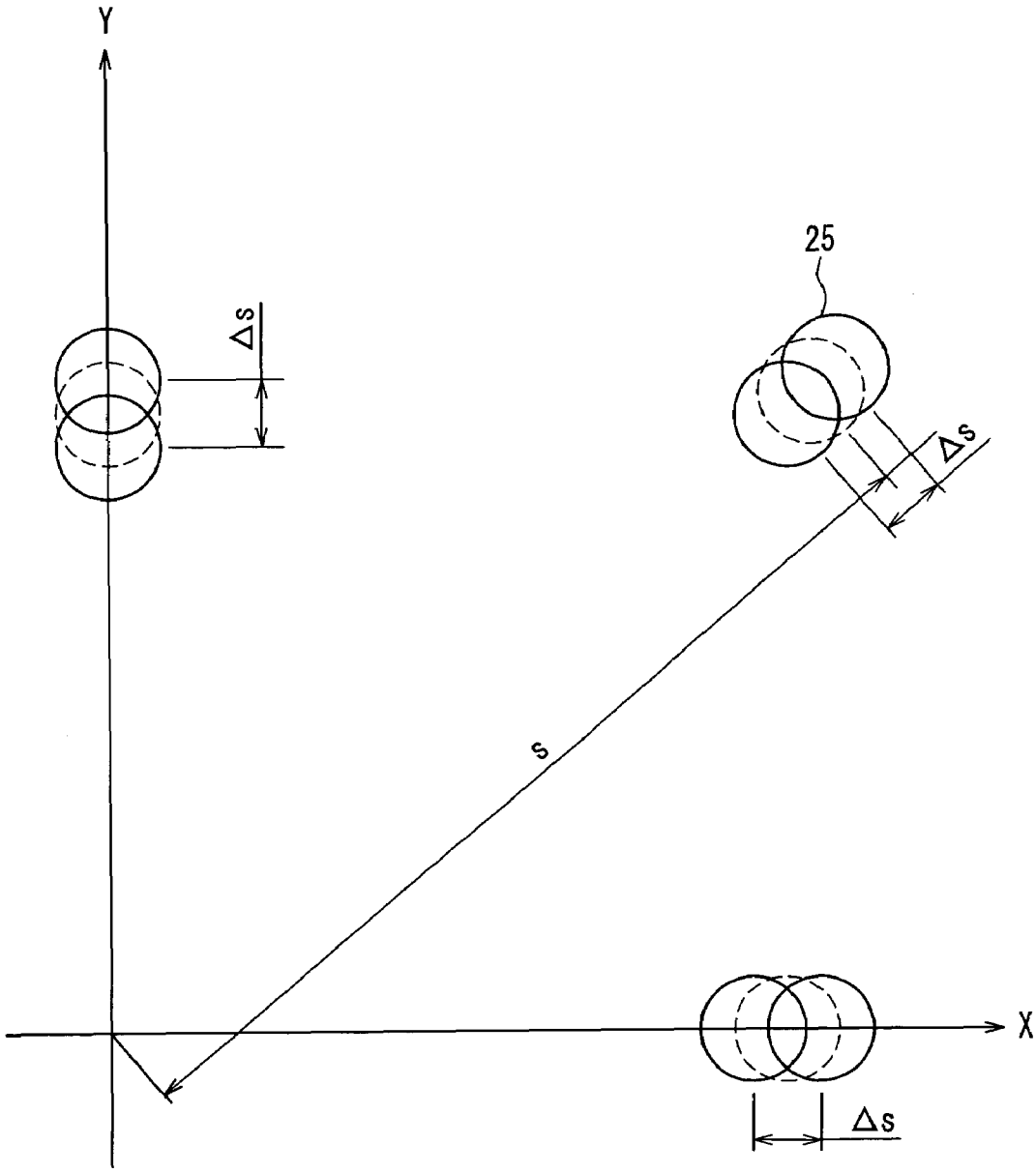
FIG. 4 is a diagram schematically showing effects of a minute variation of a high voltage applied to an anode portion of a projection tube apparatus on the image quality.

FIG. 4 shows the effects of the minute variation of a high voltage applied to the anode portion on the image quality. The variation of a high voltage applied to the anode portion 29 affects the variation of speed of the electron beam 25 traveling in the deflection fields generated by the deflection device. Thus, the time during which the electron beam 25 is subjected to the Lorentz force from the deflection field varies, so that the deflection amount "s" of the electron beam 25 varies, as shown in FIG. 4. The variation As of this deflection amount "s" results in flicker on the screen and causes deterioration of the image quality.

Figure 5:
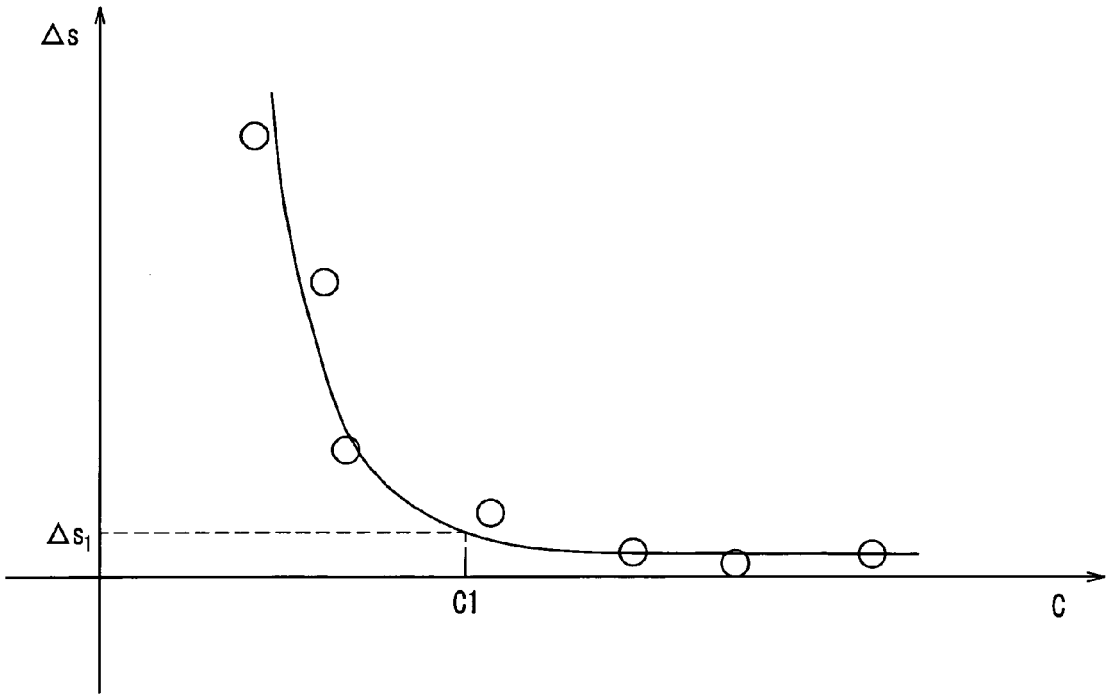
FIG. 5 is a graph showing the relationship between a capacitance C of a projection tube apparatus and a variation As of deflection amount "s" of an electron beam.

The inventors investigated the effects of variation of the capacitance C of the projection tube apparatus 19 on the variation of the deflection amount "s" of the electron beam 25. FIG. 5 shows the relationship, obtained from the experiments, between the capacitance C of the projection tube apparatus and the variation Δs of the deflection amount "s" of the electron beam. As shown in FIG. 5, it has been found that if the capacitance C of the projection tube apparatus 19 is at least a desired value of C1 (=130 pF), then the variation Δs of the deflection amount "s" of the electron beam 25 is at most $\Delta s_1$ (=0.05 mm) and the flicker on the screen will be at such a level that there is no problem in practical use.

Figure 6:
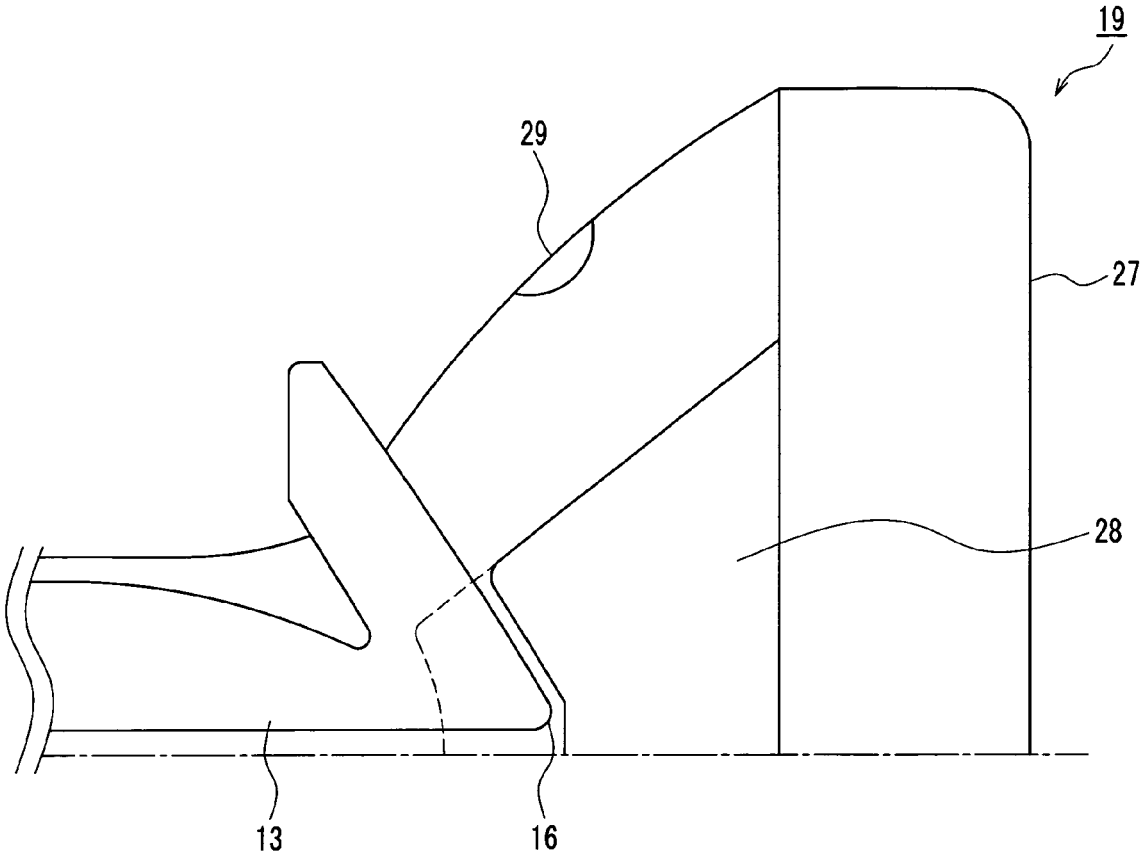
FIG. 6 is a side view (top half only) showing the positional relationship between an end portion of the horizontal deflection coils on the screen face side and an external conducting material of a projection tube apparatus according to an embodiment of the present invention.

Next, the relationship between the capacitance C of the projection tube apparatus 19 and the end portion 16 of the horizontal deflection coils 13 on the screen face 27 side is described. As shown in FIG. 6, when the end portion 16 of the horizontal deflection coils 13 on the screen face 27 side is extended to the screen face 27 side, it is necessary to make the coating area of the external conducting material 28 smaller to prevent interference between the external conducting material 28 and the horizontal deflection coils 13. Accordingly, the capacitance C of the projection tube apparatus 19 decreases. It should be noted that the portion depicted by the broken line of the external conducting material 28 in FIG. 6 shows an end portion of the coating area of the external conducting material on the electron gun side in a conventional projection tube apparatus.

Figure 7:
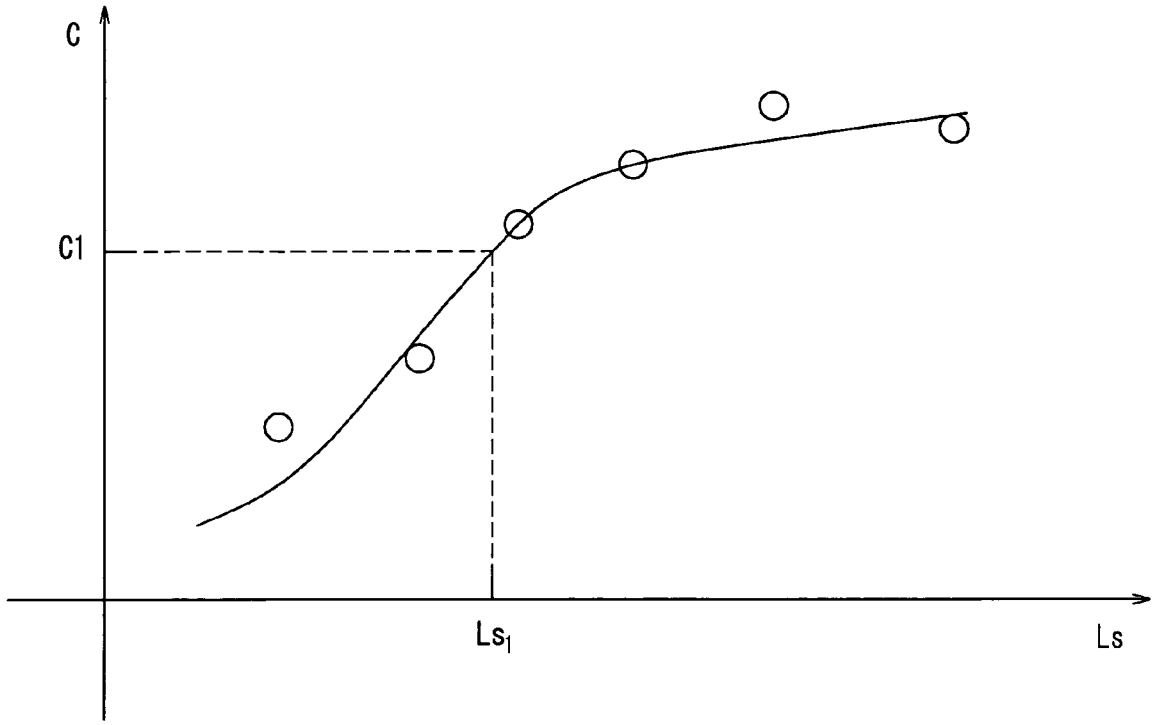
FIG. 7 is a graph showing the relationship between a distance Ls between the end portion of the horizontal deflection coils on the screen face side and the screen face, and the capacitance C of a projection tube apparatus.

The inventors investigated the effects of the variation of the distance Ls between the end portion 16 of the horizontal deflection coils 13 on the screen face 27 side and the screen face 27 on the variation of the capacitance C of the projection tube apparatus 19. FIG. 7 shows the relationship, obtained from the experiments, between the distance Ls between the end portion of the horizontal deflection coils on the screen face side and the screen face and the capacitance C of the projection tube apparatus. As shown in FIG. 7, it has been found that the capacitance C of the projection tube apparatus 19 increases as the distance Ls between the end portion 16 of the horizontal deflection coils 13 on the screen face 27 side and the screen face 27 increases, but the change in the capacitance C is small for $Ls \geqq Ls_1$ (=55 mm).

Figure 8:
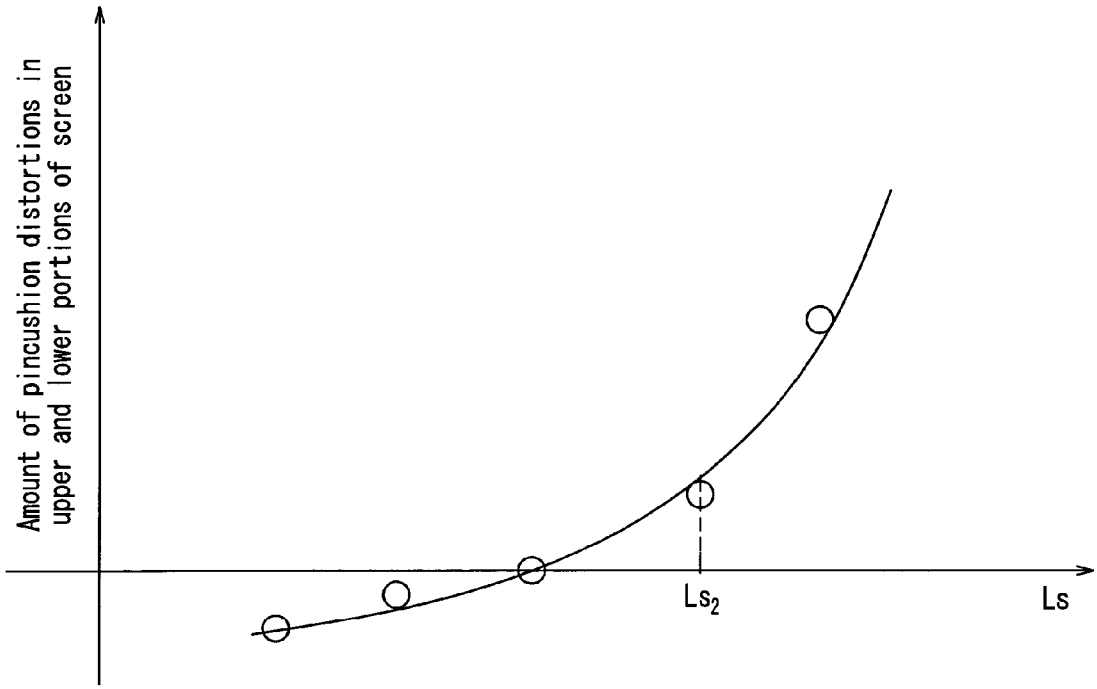
FIG. 8 is a graph showing the relationship between the distance Ls between the end portion of the horizontal deflection coils on the screen face side and the screen face, and the amount of pincushion distortions in upper and lower portions of the screen.

Furthermore, the inventors investigated the effects of the variation of the distance Ls between the end portion 16 of the horizontal deflection coils 13 on the screen face 27 side and the screen face 27 on the amount of the pincushion distortion in the upper and lower portions of the screen. FIG. 8 shows the relationship, obtained from the experiments, between the distance Ls between the end portion of the horizontal deflection coils on the screen face side and the screen face and the amount of pincushion distortion in the upper and lower portions of the screen. As shown in FIG. 8, it has been found that as the distance Ls between the end portion 16 of the horizontal deflection coils 13 on the screen face 27 side and the screen face 27 increases, the change in amount of the pincushion distortion in the upper and lower portions of the screen is small until $Ls=Ls_2$ (=80 mm), but the change in amount of the pincushion distortion in the upper and lower portions of the screen begins to increase dramatically at $Ls \geqq Ls_2$ (=80 mm).

Accordingly, as evident from FIG. 5 and FIG. 7, a capacitance ($C \geqq C1$) that presents no problem in practical use in terms of screen flicker can be obtained by setting the distance Ls between the end portion 16 of the horizontal deflection coils 13 on the screen face 27 side and the screen face 27 to $Ls \geqq Ls_1$ (=55 mm). Furthermore, as evident from FIG. 8, the distance Ls between the end portion 16 of the horizontal deflection coils 13 on the screen face 27 side and the screen face 27 should be set to $Ls \leqq Ls_2$ (=80 mm) from the viewpoint of reducing the amount of the pincushion distortion in the upper and lower portions of the screen. Thus, by setting the distance Ls between the end portion 16 of the horizontal deflection coils 13 on the screen face 27 side and the screen face 27 to $Ls_1$ (=55 mm)$\leqq Ls \leqq Ls_2$ (=80 mm), the pincushion distortions in the upper and lower portions of the screen can be corrected efficiently without causing flicker on the screen.

Figure 9:
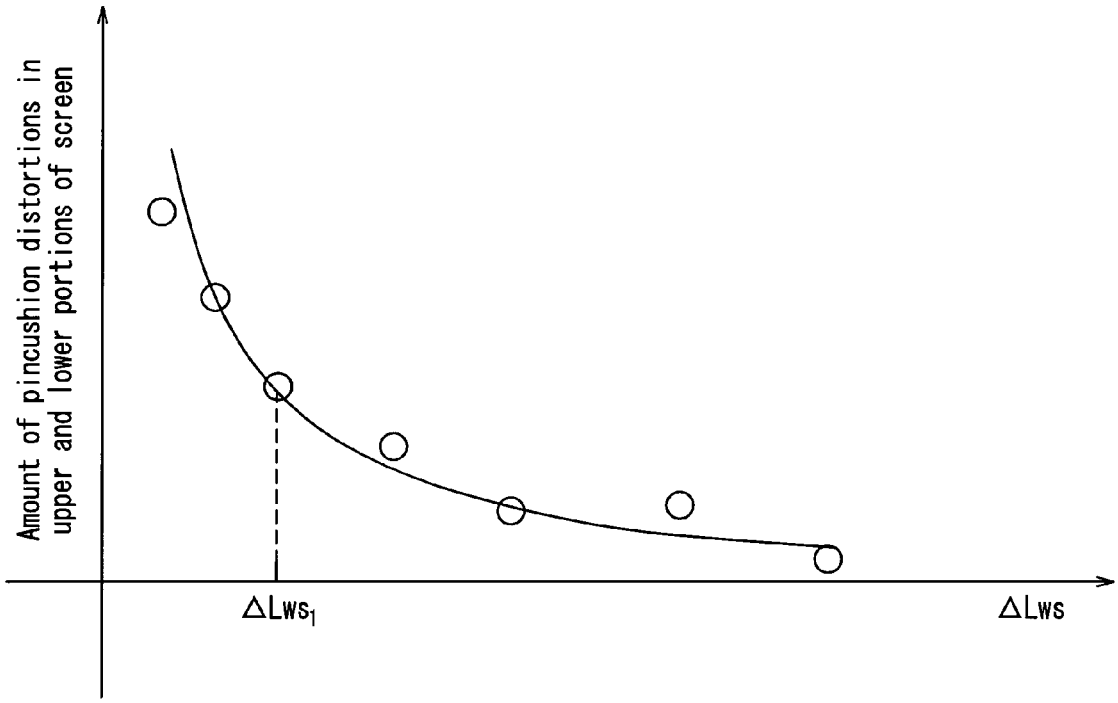
FIG. 9 is a graph showing the relationship between a difference ΔLws (=Lw−Ls) between the distance Ls between the end portion of the horizontal deflection coils on the screen face side and the screen face and a distance Lw between a position on the Z-axis (tube axis) where a height in the direction of Y-axis (vertical axis) of a bend portion of the horizontal deflection coils on the screen face side is highest and the screen face, and the amount of the pincushion distortions in the upper and lower portions of the screen.

Next, the inventors investigated the effects of the variation of the difference ΔLws (=Lw−Ls) between Ls and Lw on the amount of the pincushion distortion in the upper and lower portions of the screen. FIG. 9 shows the relationship, obtained from the experiments, between the difference ΔLws (=Lw−Ls) between Ls and Lw and the amount of the pincushion distortion in the upper and lower portions of the screen. As shown in FIG. 9, it has been found that as the difference ΔLws (=Lw−Ls) between Ls and Lw decreases, the change in amount of the pincushion distortion in the upper and lower portions of the screen is small until $\Delta Lws=\Delta Lws_1$ (=5 mm), but the change in amount of the pincushion distortion in the upper and lower portions of the screen begins to increase dramatically at $\Delta Lws \leqq \Delta Lws_1$ (=5 mm).

Figure 10:
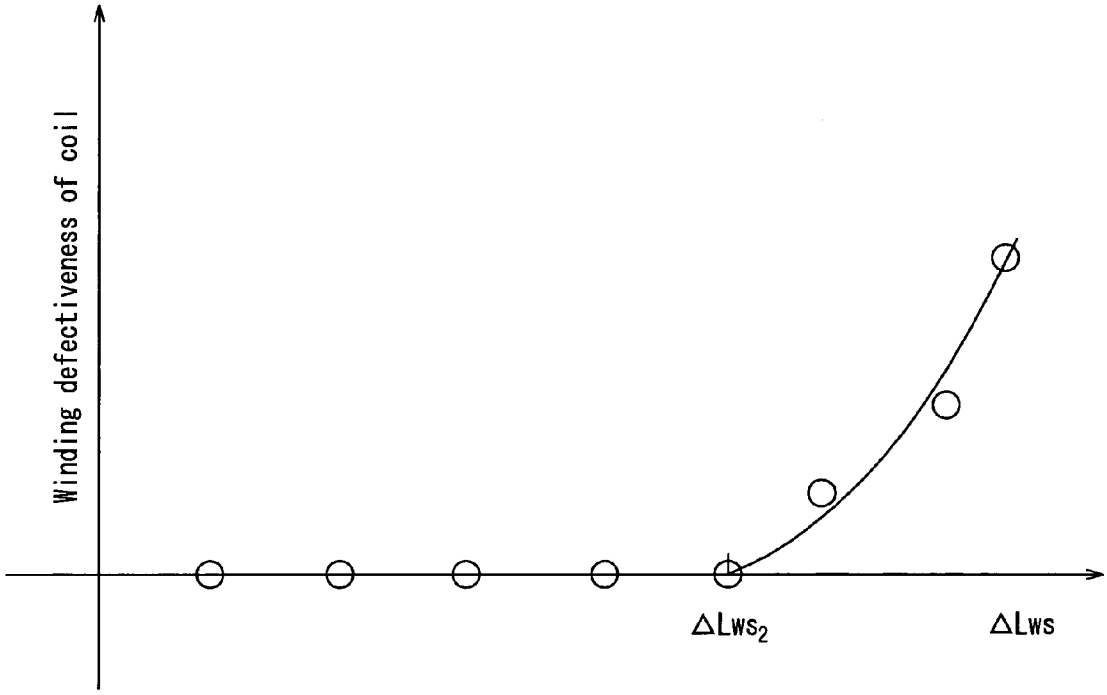
FIG. 10 is a graph showing the relationship between the difference ΔLws (=Lw−Ls) between the distance Ls between the end portion of the horizontal deflection coils on the screen face side and the screen face and the distance Lw between the position on the Z-axis (tube axis) where the height in the direction of Y-axis (vertical axis) of the bend portion of the horizontal deflection coils on the screen face side is highest and the screen face, and winding defects of the horizontal deflection coils.
Figure 11:
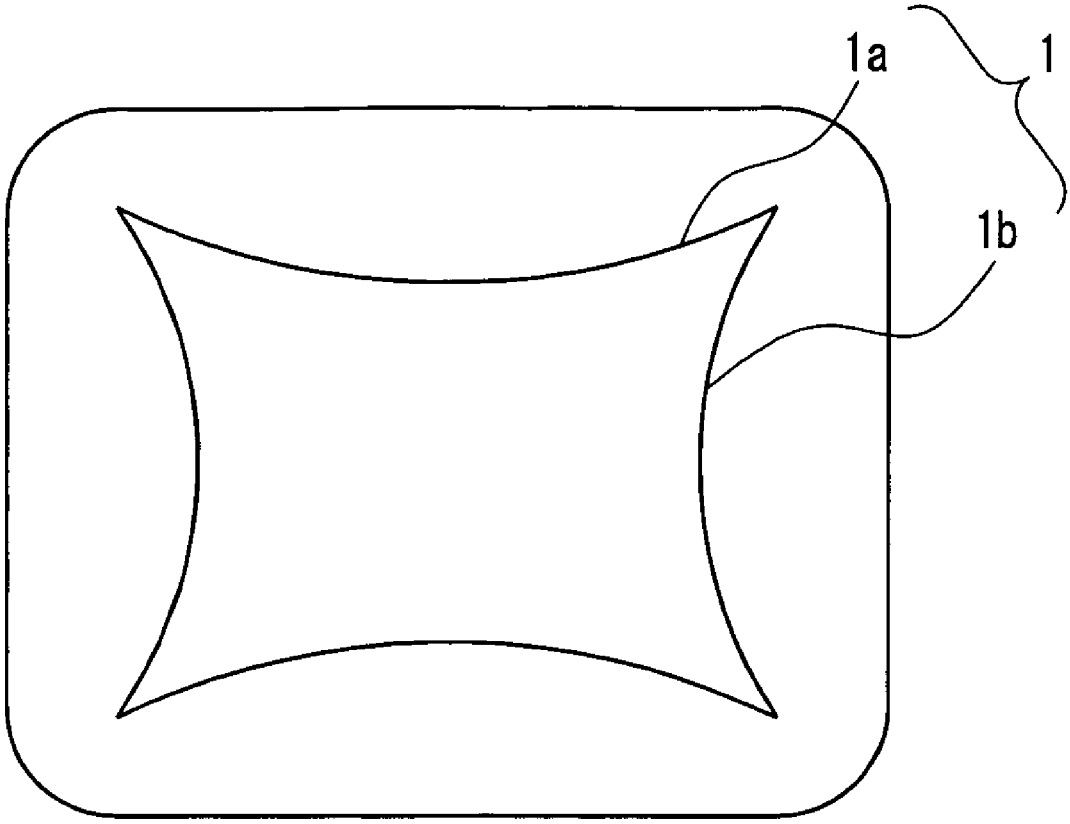
FIG. 11 PRIOR ART
FIG. 11 is a diagram for schematically illustrating the pincushion distortions in a conventional projection tube apparatus.
Figure 12:
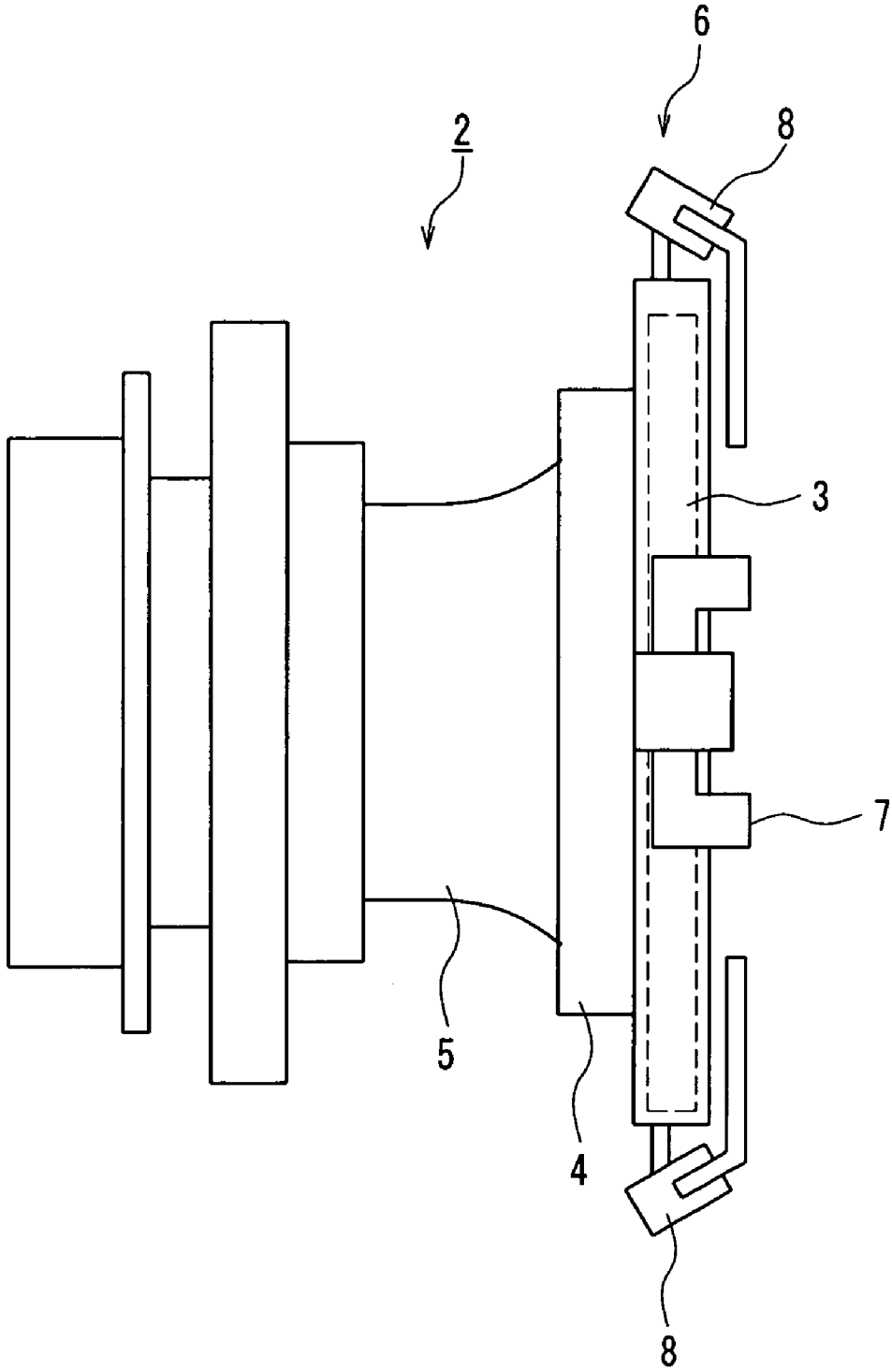
FIG. 12 PRIOR ART
FIG. 12 is a side view showing a conventional deflection device.
Figure 13:
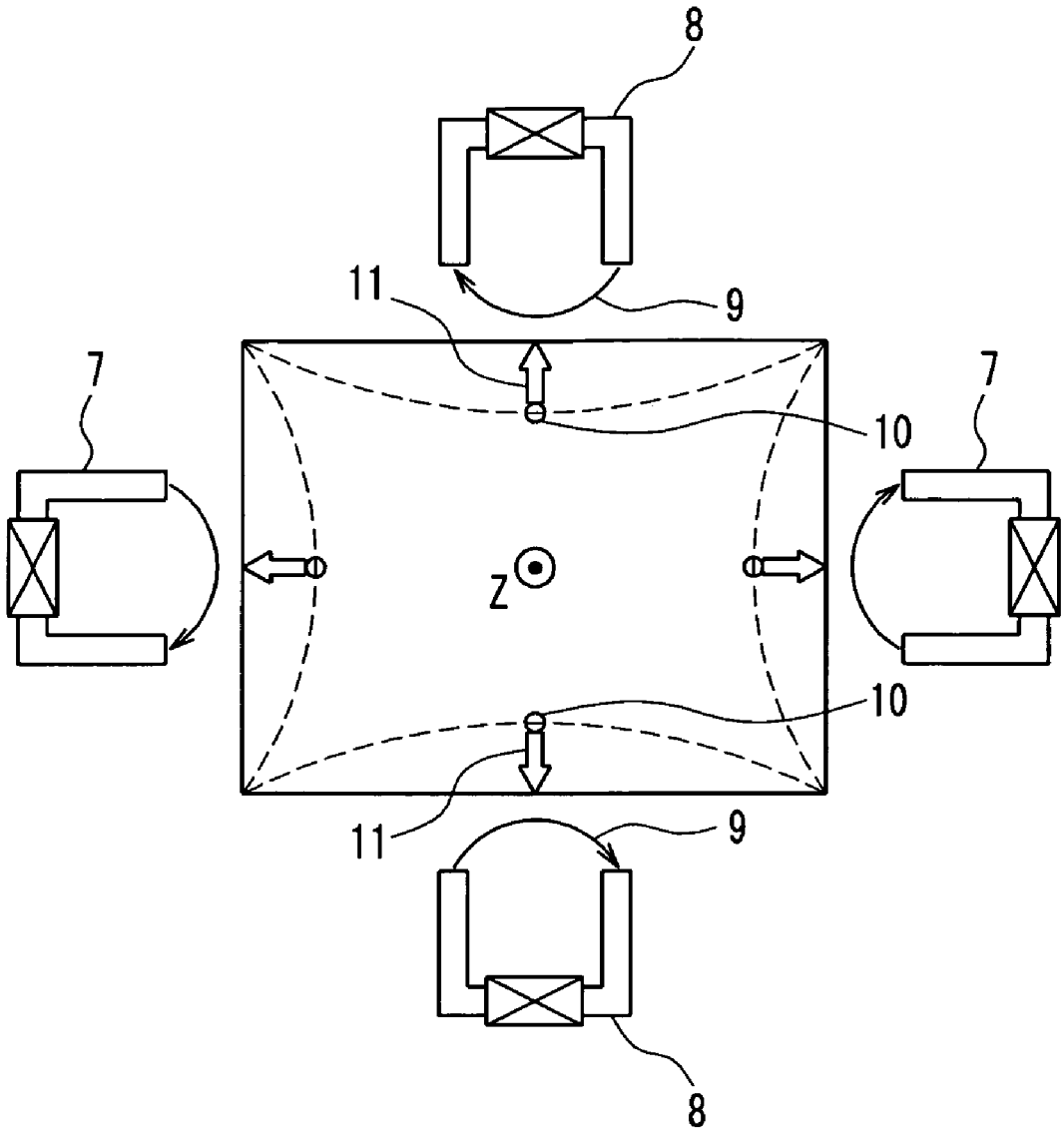
FIG. 13 PRIOR ART
FIG. 13 is a diagram for schematically illustrating the operations of the conventional deflection device.

Furthermore, the inventors investigated the effects of the variation of the difference ΔLws (=Lw−Ls) between Ls and Lw on winding defects of the horizontal deflection coils 13. It should be noted that the "winding defect" mentioned here means that scratches such as pinholes are caused on the covering of the coils. FIG. 10 shows the relationship, obtained from the experiments, between the difference ΔLws (=Lw−Ls) between Ls and Lw and the winding defects of the horizontal deflection coils. As shown in FIG. 10, it has been found that the winding defectiveness of the horizontal deflection coils 13 is approximately 0, which presents no problem in practical use, at $\Delta Lws \leqq \Delta Lws_2$ (=20 mm), but the winding defectiveness of the horizontal deflection coils 13 begins to increase dramatically at $\Delta Lws \geqq \Delta Lws_2$ (=20 mm).

Accordingly, as evident from FIG. 9 and FIG. 10, by setting the difference ΔLws between Ls and Lw to $\Delta Lws_1$ (=5 mm)$\leqq \Delta Lws \leqq \Delta Lws_2$ (=20 mm), the pincushion distortion in the upper and lower portions of the screen can be corrected efficiently while suppressing the winding defects of the horizontal deflection coils 13 to a level that presents no problem in practical use.

The inventors manufactured and tested a prototype of 7-inch projection tube apparatus having the configuration of this embodiment, and were able to confirm that the pincushion distortions in the upper and lower portions of the screen become nearly zero. Furthermore, the screen flicker was not seen, and there was no winding defect of the horizontal deflection coils.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A projection tube apparatus comprising:

a valve comprising a face panel having a screen face on its external face, a funnel connected to a rear portion of the face panel, and a neck portion;

an electron gun that emits an electron beam and is housed in the neck portion; and a deflection device mounted at an outer circumference of the funnel on the neck portion side;

wherein the deflection device at least comprises: horizontal deflection coils that generate a horizontal deflection field for deflecting the electron beam in a horizontal direction; vertical deflection coils that generate a vertical deflection field for deflecting the electron beam in a vertical direction and is disposed outside the horizontal deflection coils; and a core disposed outside the vertical deflection coils; and wherein a distance Ls between an end portion of the horizontal deflection coils on the screen face side and the screen face is set to 55 mm$\leqq$Ls$\leqq$80 mm.

2. The projection tube apparatus according to claim 1, wherein the distance Ls between the end portion of the horizontal deflection coils on the screen face side and the screen face is set smaller than a distance Lw between a position on a Z-axis (tube axis) where a height in a direction of Y-axis (vertical axis) of a bend portion of the horizontal deflection coils on the screen face side is highest and the screen face, and a difference ΔLws=Lw−Ls between Ls and Lw is set to 5 mm$\leqq$ΔLws$\leqq$=20 mm.

* * * * *